US007506849B1

(12) United States Patent
Koster et al.

(10) Patent No.: US 7,506,849 B1
(45) Date of Patent: Mar. 24, 2009

(54) PORTABLE BLOW DRYER HOLDER AND ASSOCIATED METHOD

(76) Inventors: Judy Koster, 1187 Wade St., Highland Park, IL (US) 60035; Thomas Szafranski, 1187 Wade St., Highland Park, CA (US) 60035

( * ) Notice: Subject to any disclaimer, the term of this patent is extended or adjusted under 35 U.S.C. 154(b) by 5 days.

(21) Appl. No.: 11/810,875

(22) Filed: Jun. 7, 2007

Related U.S. Application Data

(60) Provisional application No. 60/811,625, filed on Jun. 7, 2006.

(51) Int. Cl.
*A47B 96/06* (2006.01)

(52) U.S. Cl. ..... 248/214; 248/222.52; 248/309.1; 34/239

(58) Field of Classification Search ..... 248/308, 248/309.1, 202.1, 214, 304, 222.52; 34/239, 34/227
See application file for complete search history.

(56) References Cited

U.S. PATENT DOCUMENTS 1,349,051 A * 8/1920 Dular ..... 248/103
1,741,937 A * 5/1929 Anderson ..... 340/686.1
2,048,612 A * 7/1936 Maguire ..... 248/103
2,074,736 A * 3/1937 Whitten ..... 248/103
2,415,186 A * 2/1947 Moore ..... 248/103
4,673,148 A * 6/1987 Oliver ..... 248/292.14
4,712,313 A * 12/1987 Gettleman ..... 34/97
5,761,825 A 6/1998 Ammon et al.
5,764,792 A * 6/1998 Kennealy ..... 382/133
5,842,670 A 12/1998 Nigoghosian
D456,657 S * 5/2002 Mar ..... D6/567
6,491,267 B1 * 12/2002 Feldman ..... 248/176.1
6,764,052 B1 7/2004 Wise
6,997,421 B2 * 2/2006 Reynolds et al. ..... 248/117.2
2007/0075204 A1 * 4/2007 Fertil ..... 248/309.1

* cited by examiner

*Primary Examiner*—Amy J. Sterling

(57) ABSTRACT

A portable blow dryer holder for assisting a user to employ an existing blow dryer while simultaneously practicing grooming procedures with both hands includes a plurality of coextensively shaped rectilinear support arms with top and bottom ends, a rectilinear bar, a rectilinear male portion, and a plurality of rectilinear casings. The holder further includes a plurality of coextensively shaped hooks, a mechanism for securing the existing blow dryer within the apparatus during operating conditions, and a rectilinear beam with axially opposed ends.

6 Claims, 5 Drawing Sheets

PORTABLE BLOW DRYER HOLDER AND ASSOCIATED METHOD

CROSS REFERENCE TO RELATED APPLICATIONS

This application claims the benefit of U.S. Provisional Application No. 60/811,625, filed Jun. 7, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to holding apparatuses and, more particularly, to a portable blow dryer holder and associated method for assisting a user to employ an existing blow dryer while simultaneously practicing grooming procedures with both hands.

2. Prior Art

Handheld hair dryers are a necessity for most consumers, although use of one is not without drawbacks. Specifically, trying to hold a blow dryer in one hand, while styling the hair with the other, can be difficult at best. As many consumers, particularly females, "brush-out" their hair while they are blowing it dry, a hairbrush, comb or curling brush must all be held in conjunction with the blow dryer. Because styling the hair in this manner involves holding two or more styling tools, as well as a blow dryer, doing so requires lithe fingers and keen hand-eye coordination. Unfortunately, many consumers, particularly those who are older or suffer limited mobility, simply lack the manual dexterity to perform this awkward task. Constantly shutting off the blow dryer and setting it down, in order to adjust a hairbrush, add or remove a curler, or apply a hair clip can be a completely frustrating and tedious experience. Another disadvantage of using a handheld blow dryer is that doing so for prolonged periods can result in sore arms and wrists.

U.S. Pat. No. 5,761,825 to Ammon discloses a hands free hair dryer and holder comprising a portable hair dryer. A structure is for supporting the portable hair dryer in a stationary adjustable manner, enabling a person to position the portable hair dryer towards the hair so that both hands are free to do other things while drying the hair. Unfortunately, this prior art example is not designed to attach to various types of surfaces.

U.S. Pat. No. 5,842,670 to Nigoghosian discloses an apparatus for supporting an electrical hair dryer or other electrical implement having an elongated portion. The apparatus includes a base from which projects a flexible tube. At the other end of the flexible tube a hair dryer holder is arranged to receive a hair dryer. When the hair dryer is inserted into the holder, the flexible tube may be positioned into any of a number of various orientations. This provides the user with enhanced operability of the stand because the user may arrange the flexible tube in a variety of positions. Unfortunately, this prior art example is not designed to attach to various types of surfaces.

U.S. Pat. No. 6,764,052 to Wise discloses a holder for a hand held appliance with first and second hook members for supporting the handle and head of the appliance, respectively, and at least one cross bar for connecting the two hook members together such that the hook members project outwardly from a flat surface to which the holder is secured. The hook members and cross bar are formed separately and are releasably secured to one another prior to attachment to a flat surface. Unfortunately, this prior art example must be attached to a flat surface, and is not designed to attach to various types of surfaces.

Accordingly, the present invention is disclosed in order to overcome the above noted shortcomings. The present invention satisfies such a need by providing an apparatus that is convenient and easy to use, lightweight yet durable in design, and designed for assisting a user to employ an existing blow dryer while simultaneously practicing grooming procedures with both hands. The portable blow dryer holder offers a user an easy, hands free means of drying the hair. Securely elevating a standard blow dryer, use of the portable blow dryer holder allows a user to comfortably style their hair, using a myriad of products, in an easy fashion. The present invention eliminates the need to juggle a hairbrush, curlers or hairpins in one hand, while holding a blow dryer in the other hand. Also, the portable blow dryer holder would relieve the sore arms and aching wrists that are associated with drying long or thick hair could be effectively eliminated. The present invention is simple to use, inexpensive, and designed for many years of repeated use.

BRIEF SUMMARY OF THE INVENTION

In view of the foregoing background, it is therefore an object of the present invention to provide an apparatus for assisting a user to employ an existing blow dryer while simultaneously practicing grooming procedures with both hands. These and other objects, features, and advantages of the invention are provided by a portable blow dryer holder.

A portable blow dryer holder for assisting a user to employ an existing blow dryer while simultaneously practicing grooming procedures with both hands includes a plurality of coextensively shaped rectilinear support arms with top and bottom ends respectively. Such support arms effectively include a rectilinear bar with a medial portion monolithically formed within an upper surface of each respective bottom end of the support arms. Such bars have a longitudinal length equal to a lateral width of the bottom ends of the support arms. The longitudinal length of the bars is oriented perpendicular to the longitudinal length of the support arms, and the bars have a lower surface spaced from the upper surface of the support arms during operating conditions.

Each of the support arms further includes a rectilinear male portion and a plurality of rectilinear casings with opposed top and bottom ends respectively. Such casings are suitably shaped and sized such that the male portions are telescopically interfitted within an associated one of the casings during operating conditions. Each of the casings is conveniently provided with a channel formed in a top surface thereof and extending along a major longitudinal length thereof. Such a top surface of each of the respective casings has a plurality of diametrically opposed notches formed therein and disposed adjacent to the channels. The bars advantageously reside within associated ones of the notches of the casings when the male portions are telescopically interfitted within the casings. The notches and the bars cooperate to prevent the male portions from prematurely and undesirably shifting position within the casings during operating conditions.

The portable blow dryer holder further includes a plurality of coextensively shaped hooks provided with opposed first and second ends respectively. Such second ends of the hooks are pivotally attached to an associated one of the top ends of the support arms. Such hooks are substantially L-shaped such that a second portion of each of said hooks are oriented along a horizontal plane while a first portion of each of said hooks are oriented along a vertical plane during operating conditions. Such second portions of said hooks effectively extend outwardly and away from said support arms such that said first portions and said first ends are respectively spaced from said support arms during operating conditions. Such first ends of said hooks are simultaneously and independently biased along mutually exclusive arcuate paths defined about respective fulcrum axes defined along said longitudinal lengths of said support arms respectively.

The apparatus further includes a mechanism for securing the existing blow dryer within the apparatus during operating conditions. Such a securing mechanism is pivotally coupled directly to the bottom ends of the support arms. The securing mechanism is conveniently articulated along an arcuate path defined between a horizontal plane and a vertical plane respectively.

The securing mechanism advantageously includes a cradle with proximal and distal portions respectively. Such a proximal portion of the cradle is telescopically interfitted within the distal portion. The proximal and distal portions have respective concave upper surfaces in fluid communication with each other, and the cradle is provided with a slot formed therein and has a centrally registered longitudinal axis oriented parallel to a longitudinal length of the cradle. Such a slot is suitably shaped and sized for receiving a variety of existing blow dryers therein during operating conditions.

The proximal portion of the cradle is hingedly attached directly to respective inner faces of the bottom ends of the casings and has a lateral width that is less than the longitudinal length of the beam such that the cradle resides medially of the respective inner surfaces of the support arms and the beam respectively when the cradle is biased upwardly during non-operating conditions. The distal portion of the cradle effectively has a circular opening monolithically formed thereat. Such an opening has a centrally registered axis oriented parallel with the longitudinal length of the cradle and a diameter sized such that a variety of existing blow dryer nozzles interfit therethrough during operating conditions.

An inner surface of the opening and the upper surface of the cradle respectively are covered with a heat resistant non-skid material such that an existing blow dryer is prohibited from prematurely and undesirably exiting the cradle during operating conditions. Further, the hooks and the securing mechanism are independently and simultaneously pivotal about orthogonally juxtaposed first and second axes respectively.

The blow dryer holder further includes a rectilinear beam with axially opposed ends. Such ends of the beam are monolithically formed with respective inner surfaces of the support arms and spanning therebetween. The beam conveniently has a longitudinal axis oriented perpendicular to a longitudinal axis of the respective support arms and is located adjacent to the top ends of the support arms.

A method for supporting a portable blow dryer while a user practices grooming procedures with both hands includes the steps of: providing a plurality of coextensively shaped rectilinear support arms with top and bottom ends respectively and pivotally attaching a plurality of coextensively shaped hooks to an associated one of the support arms respectively. Such hooks are provided with opposed first and second ends respectively. The steps further include securing the existing blow dryer within the holder during operating conditions and articulating the blow dryer along an arcuate path defined between a horizontal plane and a vertical plane during operating and non-operating conditions respectively.

The method further includes the step of providing a rectilinear beam with axially opposed ends. Each of the ends of the beam is monolithically formed with respective inner surfaces of the support arms and spanning therebetween. The beam has a longitudinal axis oriented perpendicular to a longitudinal axis of the respective support arms and is located adjacent to the top ends of the support arms.

The method further includes the step of providing a rectilinear bar with a medial portion monolithically formed within an upper surface of each respective bottom end of the support arms. Such a bar has a longitudinal length equal to a lateral width of the bottom ends of the support arms. The longitudinal length of the bars is oriented perpendicular to the longitudinal length of the support arms and the bars have a lower surface spaced from the upper surface of the support arms during operating conditions.

The method further includes the step of telescopically interfitting a proximal portion of a cradle within the distal portion. Such a cradle further has a distal portion oppositely seated from the proximal portion, the proximal and distal portions has respective concave upper surfaces in fluid communication with each other. The cradle is provided with a slot formed therein and has a centrally registered longitudinal axis oriented parallel to a longitudinal length of the cradle. Such a slot is suitably shaped and sized for receiving a variety of existing blow dryers therein during operating conditions.

The method further includes the step of hingedly attaching the proximal portion of the cradle directly to respective inner faces of the bottom ends of the casings. The cradle has a lateral width that is less than the longitudinal length of the beam such that the cradle resides medially of the respective inner surfaces of the support arms and the beam respectively when the cradle is biased upwardly during non-operating conditions. The method further includes the step of interfitting a nozzle end of the blow dryer through the distal portion of the cradle. Such a distal portion of the cradle has a circular opening monolithically formed thereat. Such an opening has a centrally registered axis oriented parallel with the longitudinal length of the cradle and a diameter sized such that a variety of existing blow dryer nozzles interfit therethrough during operating conditions. An inner surface of the opening and the upper surface of the cradle respectively are covered with a heat resistant non-skid material such that an existing blow dryer is prohibited from prematurely and undesirably exiting the cradle during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figures 1, 2:
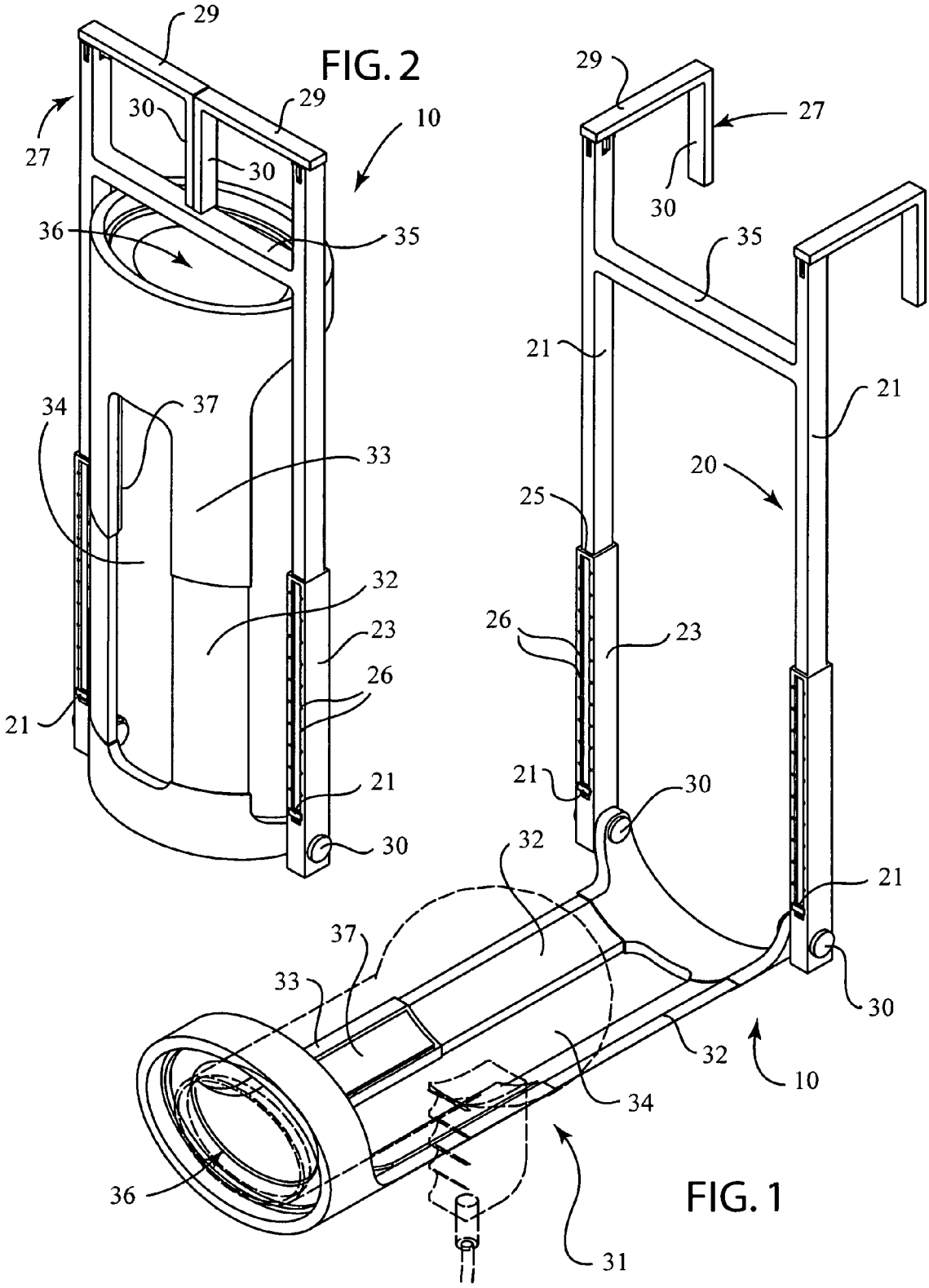
FIG. 1 is a perspective view showing a portable hair dryer holder in an open position, in accordance with the present invention.
FIG. 2 is a perspective view showing a portable hair dryer holder in a closed position, in accordance with the present invention.
Figure 3:
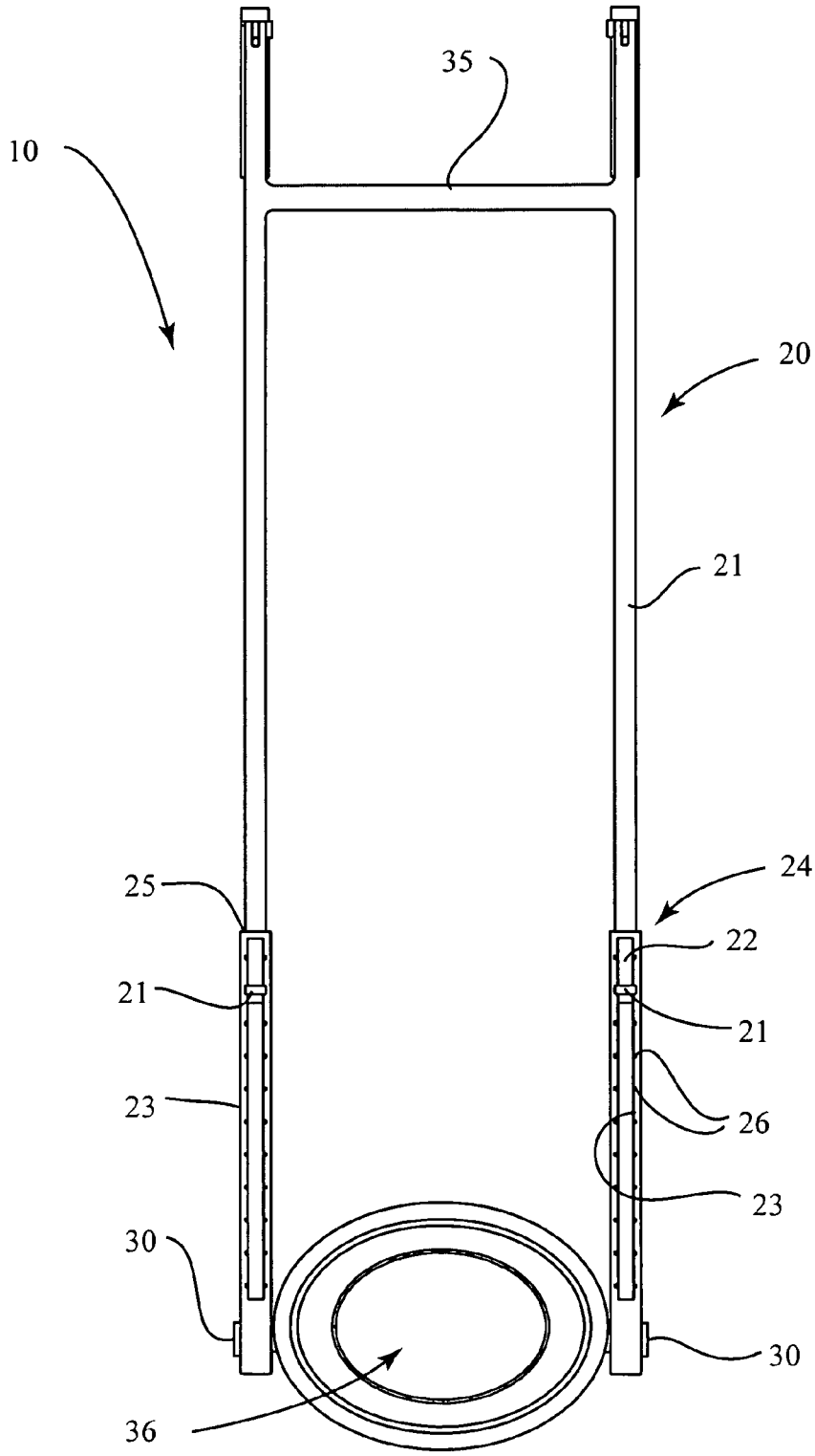
FIG. 3 is a front elevational view of the present invention.
Figure 4:
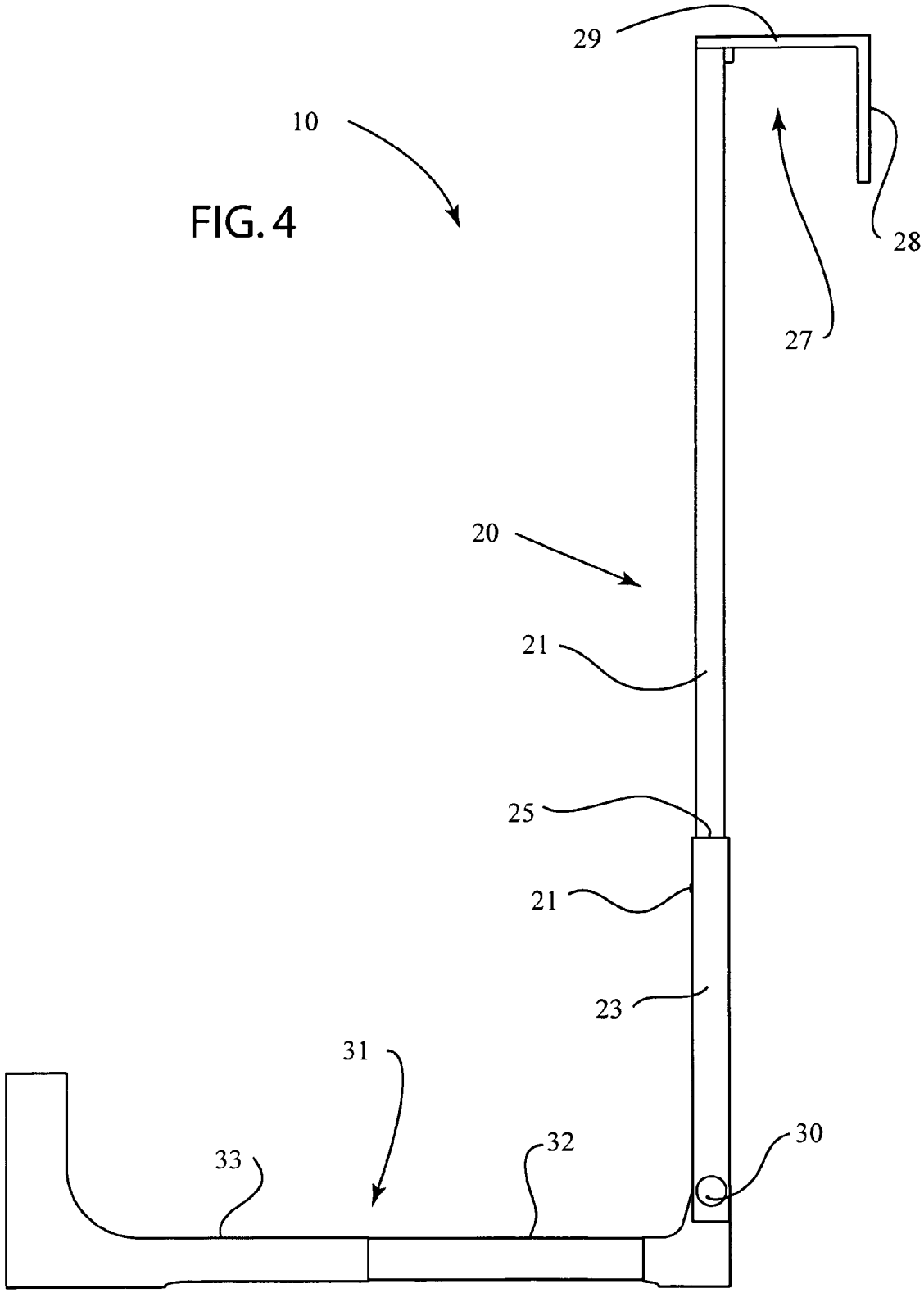
FIG. 4 is a side elevational view of the present invention.
Figure 5:
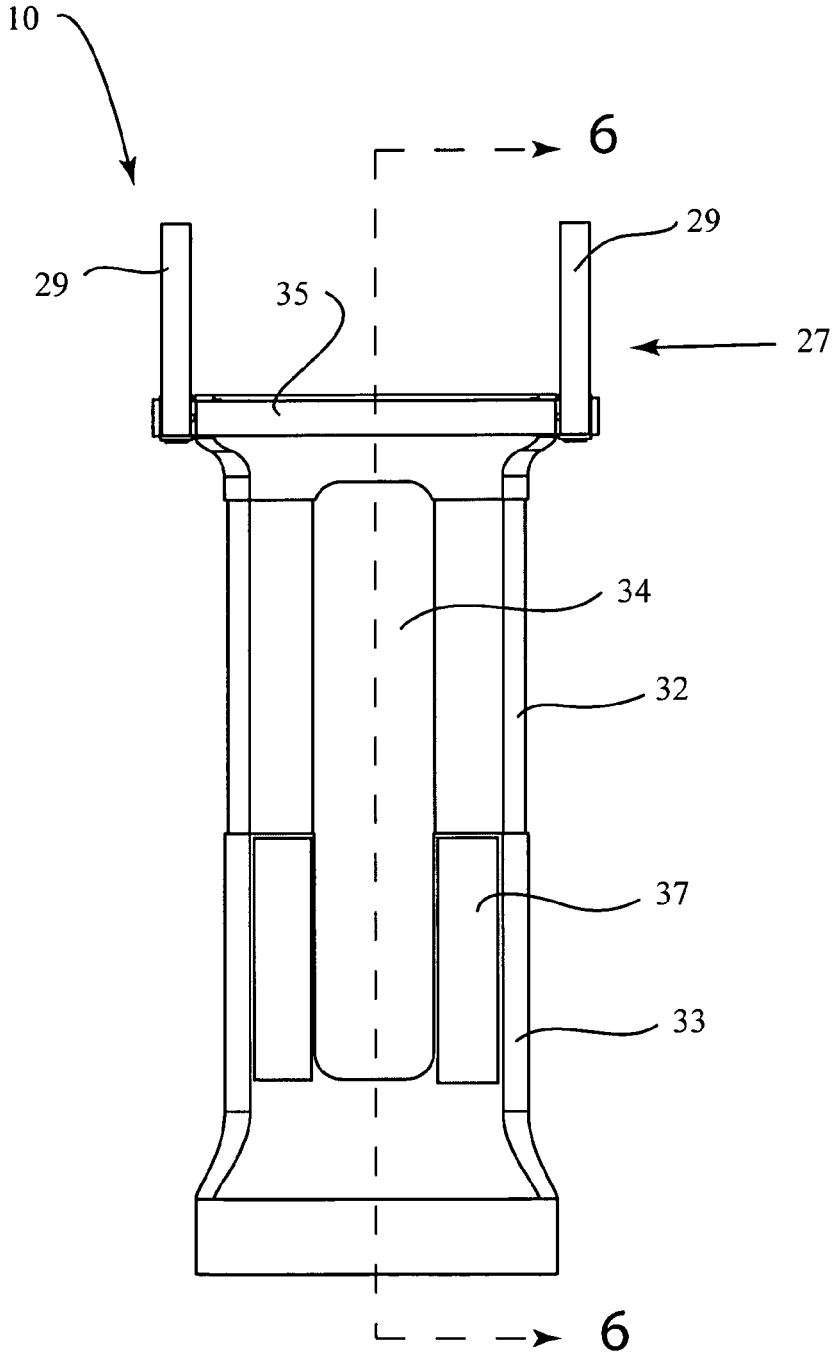
FIG. 5 is a top planar view of the present invention.
Figure 6:
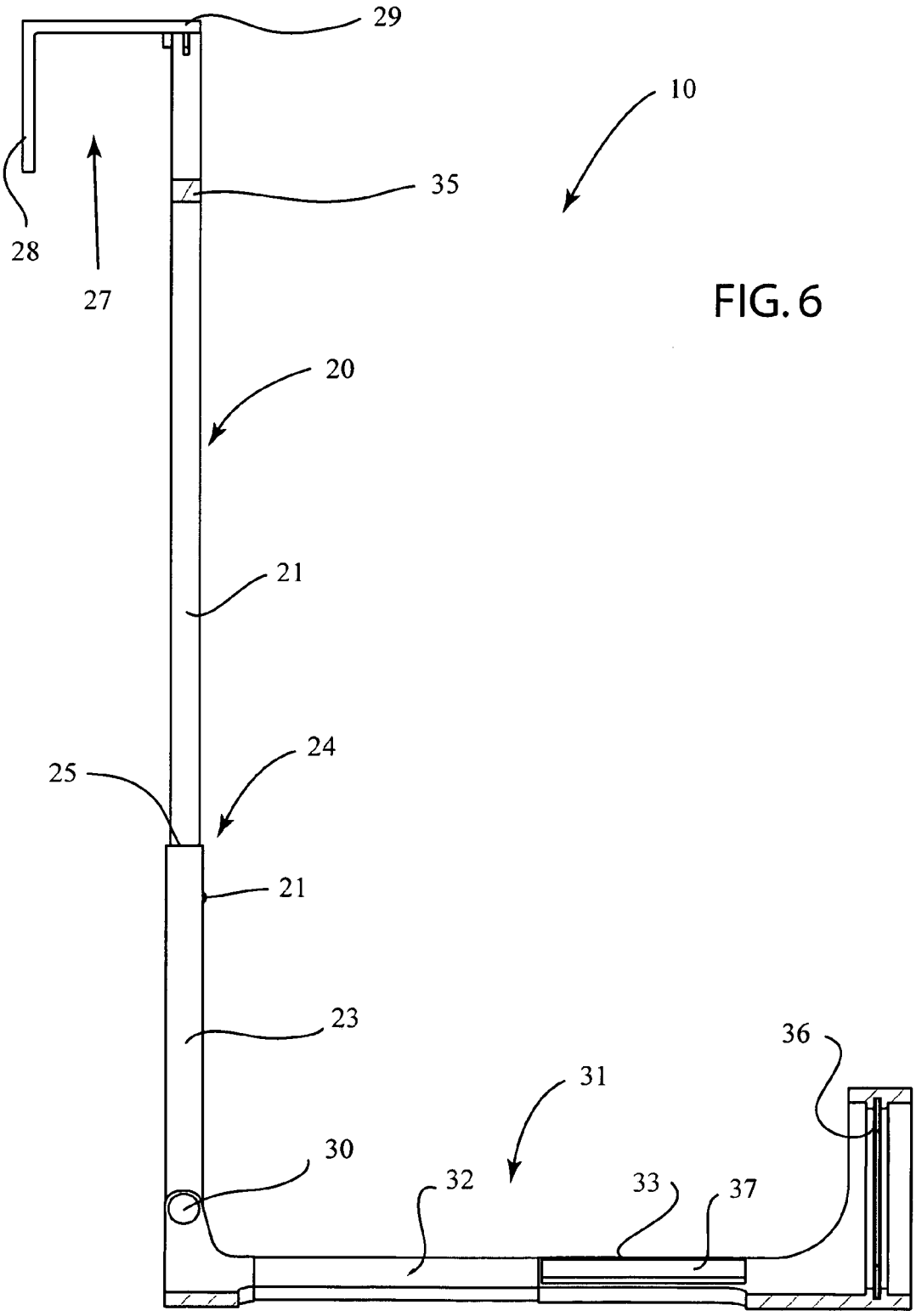
FIG. 6 is an enlarged cross-sectional view of the present invention, taken along line 6-6 as shown in FIG. 5.

The apparatus of this invention is referred to generally in FIGS. 1-6 by the reference numeral 10 and is intended to provide a portable blow dryer holder. It should be understood that the apparatus 10 may be used to support many different types of blow dryers and should not be limited to supporting only those types of blow dryers mentioned herein.

Referring initially to FIGS. 1, 2, 3, 4 and 6, a portable blow dryer holder for assisting a user to employ an existing blow dryer while simultaneously practicing grooming procedures with both hands includes a plurality of coextensively shaped rectilinear support arms 20 with top and bottom ends respectively. Such support arms 20 effectively include a rectilinear bar 21 with a medial portion monolithically formed within an upper surface of each respective bottom end of the support arms 20. Such bars 21 have a longitudinal length equal to a lateral width of the bottom ends of the support arms. The longitudinal length of the bars 21 is oriented perpendicular to the longitudinal length of the support arms 20, and the bars have a lower surface spaced from the upper surface of the support arms during operating conditions.

Referring again to FIGS. 1, 2, 3, 4 and 6, each of the support arms 20 further includes a rectilinear male portion 22 and a plurality of rectilinear casings 23 with opposed top and bottom ends respectively. Such casings 23 are suitably shaped and sized such that the male portions 22 are telescopically interfitted within an associated one of the casings 23 during operating conditions. Each of the casings 23 is conveniently provided with a channel 24 formed in a top surface 25 thereof and extending along a major longitudinal length thereof. Such a top surface 25 of each of the respective casings 23 has a plurality of diametrically opposed notches 26 formed therein and disposed adjacent to the channels 24. The bars 21 advantageously reside within associated ones of the notches 26 of the casings 23 when the male portions 22 are telescopically interfitted within the casings 23. The notches 26 and the bars 21 cooperate to prevent the male portions 22 from prematurely and undesirably shifting position within the casings 23 during operating conditions. The casings provide a user means for adjusting the extension of the support arms and thereby allow the apparatus to be adjusted according to specific user needs.

Referring to FIGS. 1, 2, 4, 5 and 6, the portable blow dryer holder further includes a plurality of coextensively shaped hooks 27 provided with opposed first and second ends respectively. Such second ends of the hooks are pivotally attached to an associated one of the top ends of the support arms 20. Such hooks 27 are substantially L-shaped which is essential such that a second portion 29 of each of said hooks 27 are oriented along a horizontal plane while a first portion 28 of each of said hooks 27 are oriented along a vertical plane during operating conditions. Such second portions 29 of said hooks 27 effectively extend outwardly and away from said support arms 20 such that said first portions 28 and said first ends are respectively spaced from said support arms 20 during operating conditions. Such first ends of said hooks 27 are simultaneously and independently biased along mutually exclusive arcuate paths defined about respective fulcrum axes defined along said longitudinal lengths of said support arms 20 respectively. The hooks allow a user to hang the apparatus from various surfaces.

Referring to FIGS. 1, 2, 3, 4 and 6, the apparatus further includes a mechanism for securing the existing blow dryer within the apparatus during operating conditions. Such a securing mechanism 30 is pivotally coupled directly to the bottom ends of the support arms 20. The securing mechanism 30 is conveniently articulated along an arcuate path defined between a horizontal plane and a vertical plane respectively. The securing mechanism ensures that the blow dryer does not shift within the apparatus during operating conditions.

Referring to FIGS. 1-6, the securing mechanism 30 advantageously includes a cradle 31 with proximal 32 and distal portions 33 respectively. Such a proximal portion 32 of the cradle is telescopically interfitted within the distal portion 33. The proximal 32 and distal portions 33 have respective concave upper surfaces in fluid communication with each other, and the cradle 31 is provided with a slot 34 formed therein and has a centrally registered longitudinal axis oriented parallel to a longitudinal length of the cradle. Such a slot 34 is suitably shaped and sized for receiving a variety of existing blow dryers therein during operating conditions.

The proximal portion 32 of the cradle 31 is hingedly attached directly to respective inner faces of the bottom ends of the casings 23 and has a lateral width that is less than the longitudinal length of the beam 35 which is crucial such that the cradle 31 resides medially of the respective inner surfaces of the support arms 20 and the beam 35 respectively when the cradle 31 is biased upwardly during non-operating conditions. The distal portion 33 of the cradle 31 effectively has a circular opening 36 monolithically formed thereat. Such an opening 36 has a centrally registered axis oriented parallel with the longitudinal length of the cradle and a diameter sized which is important such that a variety of existing blow dryer nozzles interfit therethrough during operating conditions. The opening secures the blow dryer while allowing the air flow to be directed at the user hair.

An inner surface of the opening 36 and the upper surface of the cradle 31 respectively are covered with a heat resistant non-skid material 37 which is crucial such that an existing blow dryer is prohibited from prematurely and undesirably exiting the cradle during operating conditions. Further, the hooks and the securing mechanism are independently and simultaneously pivotal about orthogonally juxtaposed first and second axes respectively.

Referring again to FIGS. 1-6, the blow dryer holder further includes a rectilinear beam 35 with axially opposed ends. Such ends of the beam 35 are monolithically formed with respective inner surfaces of the support arms and spanning therebetween. The beam 35 conveniently has a longitudinal axis oriented perpendicular to a longitudinal axis of the respective support arms 20 and is located adjacent to the top ends of the support arms 20. The beam maintains the support arms in their positions and thereby provides undesired movements of the blow dryer during operating conditions.

The hooks provide a user the unexpected benefit of allowing the apparatus to be attached to various surfaces. Also, the notches located within the casings conveniently allow the support arms to be adjusted according to a user's needs. Such benefits overcome the prior art shortcomings.

In use, a method for supporting a portable blow dryer while a user practices grooming procedures with both hands includes the steps of: providing a plurality of coextensively shaped rectilinear support arms 20 with top and bottom ends respectively and pivotally attaching a plurality of coextensively shaped hooks 27 to an associated one of the support arms 20 respectively. Such hooks 27 are provided with opposed first and second ends respectively. The steps further include securing the existing blow dryer within the holder during operating conditions and articulating the blow dryer along an arcuate path defined between a horizontal plane and a vertical plane during operating and non-operating conditions respectively.

In use, the method further includes the step of providing a rectilinear beam 35 with axially opposed ends. Each end of the beam 35 is monolithically formed with respective inner surfaces of the support arms 20 and spanning therebetween. The beam 35 has a longitudinal axis oriented perpendicular to a longitudinal axis of the respective support arms 20 and is located adjacent to the top ends of the support arms 20.

In use, the method further includes the step of providing a rectilinear bar 21 with a medial portion monolithically formed within an upper surface of each respective bottom end of the support arms 20. Such a bar 21 has a longitudinal length equal to a lateral width of the bottom ends of the support arms 20. The longitudinal length of the bars 21 is oriented perpendicular to the longitudinal length of the support arms 20 and the bars 21 have a lower surface spaced from the upper surface of the support arms 20 during operating conditions.

In use, the method further includes the step of telescopically interfitting a proximal portion of a cradle 31 within the distal portion 33. Such a cradle 31 further has a distal portion 33 oppositely seated from the proximal portion 32, the proximal and distal portions has respective concave upper surfaces in fluid communication with each other. The cradle 31 is provided with a slot 34 formed therein and has a centrally registered longitudinal axis oriented parallel to a longitudinal length of the cradle 31. Such a slot 34 is suitably shaped and sized for receiving a variety of existing blow dryers therein during operating conditions.

In use, the method further includes the step of hingedly attaching the proximal portion of the cradle 31 directly to respective inner faces of the bottom ends of the casings 23. The cradle 31 has a lateral width that is less than the longitudinal length of the beam 35 such that the cradle 31 resides medially of the respective inner surfaces of the support arms 20 and the beam 35 respectively when the cradle 31 is biased upwardly during non-operating conditions. The method further includes the step of interfitting a nozzle end of the blow dryer through the distal portion of the cradle 31. Such a distal portion 33 of the cradle 31 has a circular opening 36 monolithically formed thereat. Such an opening 36 has a centrally registered axis oriented parallel with the longitudinal length of the cradle 36 and a diameter sized such that a variety of existing blow dryer nozzles interfit therethrough during operating conditions. An inner surface of the opening 36 and the upper surface of the cradle 36 respectively are covered with a heat resistant non-skid material 37 such that an existing blow dryer is prohibited from prematurely and undesirably exiting the cradle during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method for supporting a portable blow dryer while a user practices grooming procedures with both hands, said method comprising the steps of:

a. providing a plurality of coextensively shaped rectilinear support arms having top and bottom ends respectively;

b. pivotally attaching a plurality of coextensively shaped hooks to an associated one of said support arms respectively, each of said hooks being provided with opposed first and second ends respectively;

c. securing the existing blow dryer within said holder during operating conditions; and d. articulating said blow dryer along an arcuate path defined between a horizontal plane and a vertical plane during operating and non-operating conditions respectively.

2. The method of claim 1, further comprising the step of:

e. providing a rectilinear beam having axially opposed ends, each of said ends of said beam being monolithically formed with respective inner surfaces of said support arms and spanning therebetween, said beam having a longitudinal axis oriented perpendicular to a longitudinal axis of said respective support arms, said beam being located adjacent to said top ends of said support arms.

3. The method of claim 2, wherein step a. comprises the steps of:

i. providing a rectilinear bar having a medial portion monolithically formed within an upper surface of each respective said bottom end of said support arms, said bars having a longitudinal length equal to a lateral width of said bottom ends of said support arms, said longitudinal length of said bars being oriented perpendicular to said longitudinal length of said support arms, said bars having a lower surface spaced from said upper surface of said support arms during operating conditions.

4. The method of claim 3, wherein said hooks are substantially L-shaped such that a second portion of each of said hooks is oriented along a horizontal plane while a first portion of each of said hooks is oriented along a vertical plane during operating conditions, said second portions of said hooks extending outwardly and away from said support arms such that said first portions and said first ends are respectively spaced from said support arms during operating conditions, each of said first ends of said hooks being simultaneously and independently biased along mutually exclusive arcuate paths defined about respective fulcrum axes defined along said longitudinal lengths of said support arms respectively.

5. The method of claim 4, wherein each of said support arms further comprises:

a rectilinear male portion; and a plurality of rectilinear casings having opposed top and bottom ends respectively, each of said casings being shaped and sized such that said male portions are telescopically interfitted within an associated one of said casings during operating conditions, each of said casings being provided with a channel formed in a top surface thereof and extending along a major longitudinal length thereof, said top surface of each of said respective casings having a plurality of diametrically opposed notches formed therein and disposed adjacent to said channels;

wherein said bars reside within associated ones of said notches of said casings when said male portions are telescopically interfitted within said casings, said notches and said bars cooperating to prevent said male portions from prematurely and undesirably shifting position within said casings during operating conditions.

6. The method of claim 5, wherein step c. further comprises the steps of:

i. telescopically interfitting a proximal portion of a cradle within said distal portion, said cradle further having a distal portion oppositely seated from said proximal portion; said proximal and distal portions having respective concave upper surfaces in fluid communication with each other, said cradle being provided with a slot formed therein and having a centrally registered longitudinal axis oriented parallel to a longitudinal length of said cradle, said slot being suitably shaped and sized for receiving a variety of existing blow dryers therein during operating conditions;

ii. hingedly attaching said proximal portion of said cradle directly to respective inner faces of said bottom ends of said casings, said cradle having a lateral width that is less than said longitudinal length of said beam such that said cradle resides medially of said respective inner surfaces of said support arms and said beam respectively when said cradle is biased upwardly during non-operating conditions; and iii. interfitting a nozzle end of the blow dryer through said distal portion of said cradle, wherein said distal portion of said cradle has a circular opening monolithically formed thereat, said opening having a centrally registered axis oriented parallel with said longitudinal length of said cradle, said opening having a diameter sized such that a variety of existing blow dryer nozzles interfit therethrough during operating conditions;

wherein an inner surface of said opening and said upper surface of said cradle respectively are covered with a heat resistant non-skid material such that an existing blow dryer is prohibited from prematurely and undesirably exiting said cradle during operating conditions.

* * * * *